US011536039B2

(12) United States Patent
Halberg et al.

(10) Patent No.: US 11,536,039 B2
(45) Date of Patent: Dec. 27, 2022

(54) TOWER APPARATUS

(71) Applicant: Seaway Painting, L.L.C., Livonia, MI (US)

(72) Inventors: Dan Halberg, St. Ignace, MI (US); Steve Vlahakis, Livonia, MI (US)

(73) Assignee: Seaway Painting, L.L.C., Livonia, MI (US)

( * ) Notice: Subject to any disclaimer, the term of this patent is extended or adjusted under 35 U.S.C. 154(b) by 896 days.

(21) Appl. No.: 16/204,693

(22) Filed: Nov. 29, 2018

(65) Prior Publication Data

US 2019/0177988 A1 Jun. 13, 2019

Related U.S. Application Data

(60) Provisional application No. 62/596,760, filed on Dec. 8, 2017.

(51) Int. Cl.

| | |
|---|---|
| ***E04G 3/30*** | (2006.01) |
| ***E04G 21/32*** | (2006.01) |
| ***E04G 3/32*** | (2006.01) |
| ***E04G 3/24*** | (2006.01) |
| *E04G 5/00* | (2006.01) |
| *E04G 3/28* | (2006.01) |
| *E01D 22/00* | (2006.01) |

(52) U.S. Cl.

CPC ..... *E04G 3/305* (2013.01); *E04G 3/243* (2013.01); *E04G 3/30* (2013.01); *E04G 3/32* (2013.01); *E04G 21/3266* (2013.01); *E01D 22/00* (2013.01); *E04G 5/001* (2013.01); *E04G 2003/286* (2013.01)

(58) Field of Classification Search

CPC .. E04G 3/30; E04G 3/32; E04G 3/305; E04G 3/243; E04G 21/3266; E04G 5/001; E04G 2003/286; E01D 22/00

USPC ..... 182/128, 130

See application file for complete search history.

(56) References Cited

U.S. PATENT DOCUMENTS

| | | | | |
|---|---|---|---|---|
| 2,043,128 A * | 6/1936 | Sutton | ..... | E04G 3/24 182/187 |
| 3,347,339 A | 10/1967 | Code | | |
| 3,463,271 A * | 8/1969 | St Louis | ..... | E04G 3/32 405/196 |
| 3,533,487 A * | 10/1970 | Norin | ..... | E04G 3/32 182/138 |
| 3,907,066 A | 9/1975 | Newton | | |
| 3,951,232 A | 4/1976 | Okada | | |
| 3,957,135 A | 5/1976 | Lane | | |

(Continued)

FOREIGN PATENT DOCUMENTS

| | | | | |
|---|---|---|---|---|
| CA | 2498870 A1 * | 8/2005 | ..... | E04G 5/10 |
| DE | 202012007550 U1 * | 9/2012 | ..... | E04G 3/28 |

(Continued)

*Primary Examiner* — Daniel P Cahn
*Assistant Examiner* — Candace L Bradford
(74) *Attorney, Agent, or Firm* — Seaway Painting, L.L.C.

(57) ABSTRACT

An apparatus includes a first platform, a second platform disposed above the first platform, a scaffolding connecting the first and second platforms including an upper support beam, a middle support beam, and a lower support beam, and a cable attached to the upper support beam. The lower support beam supports the first platform. The middle support beam supports the second platform. The upper support beam is disposed above the second platform.

8 Claims, 7 Drawing Sheets

(56) References Cited

U.S. PATENT DOCUMENTS

| | | | | |
|---|---|---|---|---|
| 4,257,491 | A | 3/1981 | Presnall, Jr. et al. | |
| 4,694,933 | A | 9/1987 | Sinko | |
| 4,732,234 | A * | 3/1988 | Brickman | E04G 21/3266 182/138 |
| 4,753,321 | A | 6/1988 | Winslow | |
| 8,490,749 | B2 | 7/2013 | Teichert | |
| 10,487,806 | B2 * | 11/2019 | Huot | E04G 3/243 |
| 10,801,220 | B2 * | 10/2020 | Oowaku | E04G 3/325 |
| 2004/0168854 | A1 * | 9/2004 | Azran | E04F 21/12 182/141 |
| 2007/0007074 | A1 * | 1/2007 | Lemburg | F03D 80/50 182/128 |
| 2007/0193831 | A1 | 8/2007 | Vance | |
| 2011/0116864 | A1 * | 5/2011 | Stokes | B66C 1/62 403/373 |
| 2013/0228397 | A1 | 9/2013 | Horn | |
| 2014/0054110 | A1 * | 2/2014 | Fernandez | E04G 3/30 182/19 |
| 2014/0345976 | A1 * | 11/2014 | Grumberg | E04G 3/22 52/741.1 |
| 2016/0214807 | A1 | 7/2016 | McSwain | |
| 2018/0355625 | A1 * | 12/2018 | Takagi | E04G 3/325 |
| 2020/0332548 | A1 * | 10/2020 | Mortensen | F16F 7/116 |
| 2020/0370998 | A1 * | 11/2020 | Amacker | B62D 61/12 |
| 2021/0016620 | A1 * | 1/2021 | Gokhale | B60G 13/16 |
| 2021/0155457 | A1 * | 5/2021 | Pong | B66B 9/02 |
| 2021/0213778 | A1 * | 7/2021 | Ojima | B60B 33/066 |

FOREIGN PATENT DOCUMENTS

| | | | | | |
|---|---|---|---|---|---|
| DE | 102013002886 | B3 | | 3/2014 | |
| GB | 190680 | A | | 12/1922 | |
| GB | 675859 | A | * | 7/1952 | E04H 12/10 |
| GB | 2003112 | A | * | 3/1979 | E04G 3/24 |
| GB | 2537067 | A | | 10/2016 | |
| JP | 06093713 | A | * | 4/1994 | |
| JP | 2000145126 | A | * | 5/2000 | E04G 3/24 |

* cited by examiner

TOWER APPARATUS

CROSS-REFERENCE TO RELATED APPLICATIONS

The subject patent application claims priority to and all the benefits of U.S. Provisional Patent Application No. 62/596,760 filed on Dec. 8, 2017, which is herein incorporated by reference in its entirety.

BACKGROUND

Bridges include towers to support the weight of roadways supported by the bridge. The towers can be positioned to absorb the weight of the roadways and cars moving along the roadways. The towers can extend away from the roadway, preventing access by workers on the bridge.

Workers perform maintenance on the towers. For example, the workers may paint the towers, remove debris from the towers, clean the towers, etc. Moving the workers along the towers presents a challenge because the towers may extend far away from the roadway. For example, the towers may extend more than 300 feet above the roadway and more than 200 feet below the roadway without corresponding structures to support the workers away from the roadway.

Furthermore, the towers typically extend into water, requiring structures to support the workers to extend beneath the surface of the water. Installing structures underwater can be difficult and expensive. Exposure to weather presents another challenge. In particular, wind may make performing maintenance difficult for workers, especially if the winds are greater than 40 miles per hour (mph).

While the maintenance is performed, one or more roadway lanes of the bridge may be closed, increasing traffic delays on the bridge. The increased traffic delays reduce the flow of cars on the bridge, decreasing toll collections. Delays in the maintenance result in longer roadway lane closures and thus longer traffic delays. Thus, it is desirable to complete the maintenance quickly and to reduce delays in the maintenance wherever possible.

Typically, a stationary scaffolding can be attached alongside the tower to support the workers, their equipment, and maintenance supplies while performing maintenance. For example, the scaffolding may support paint and painting tools, e.g., brushes, rollers, sprayers, etc. Because the scaffolding is stationary, the equipment and the supplies are moved manually along the scaffolding, increasing the time required to perform the maintenance.

The scaffolding can extend to the bottom of the tower beneath the surface of the water. For example, the scaffolding can extend 200 feet below the surface of the water and 500 feet above the surface of the water. The additional scaffolding below the surface of the water, where workers may not perform maintenance, may be expensive to build and to install. The time to install and to uninstall the stationary scaffolding can further delay the maintenance.

Furthermore, wind can jostle the scaffolding, increasing the difficulty of the maintenance for the workers. For example, wind speeds greater than 40 mph may jostle the scaffolding enough that the workers cannot perform maintenance at all, delaying the time necessary to perform maintenance on the towers. There remains an opportunity to design a system for a bridge tower that addresses these concerns.

SUMMARY OF THE INVENTION

An apparatus includes a first platform, a second platform disposed above the first platform, a scaffolding connecting the first and second platforms including an upper support beam, a middle support beam, and a lower support beam, and a cable attached to the upper support beam. The lower support beam supports the first platform. The middle support beam supports the second platform. The upper support beam is disposed above the second platform.

The apparatus may further include a second scaffolding and a connector connecting the scaffolding to the second scaffolding.

The cable may be arranged to vertically move the scaffolding.

The apparatus may further include a wheel. The wheel may be arranged to engage a bridge tower shaft.

The apparatus may further include a wheel and a spring urging the wheel from the scaffolding to a bridge tower shaft.

The apparatus may further include a rod connecting the spring to the wheel.

The apparatus may further include a housing. The housing may support the wheel and the rod may be fixed to the housing.

The apparatus may further include a debris shield disposed around the scaffolding.

The apparatus may further include an exterior beam connecting the lower support beam to the middle support beam.

The apparatus may further include a plurality of exterior beams connecting the lower support beam to the middle support beam.

A system includes a first bridge tower apparatus having an upper platform and a lower platform, a second bridge tower apparatus having a second upper platform and a second lower platform, and a connector extending between the first bridge tower apparatus and the second bridge tower apparatus.

The first bridge tower apparatus may include a scaffolding arranged to extend around a first tower shaft. The second bridge tower apparatus may include a second scaffolding arranged to extend around a second tower shaft.

The first tower shaft may taper from a bottom to a top. The first bridge tower apparatus may include a wheel movably engaged with the first tower shaft to move along the first tower shaft.

The scaffolding may include a lower support beam supporting the lower platform and a middle support beam supporting the upper platform.

The system may further include an exterior beam connecting the lower support beam to the middle support beam.

A system includes a bridge tower apparatus including a first platform and a second platform disposed above the first platform and a crane including a cable attached to the bridge tower apparatus.

The bridge tower apparatus may include a scaffolding supporting the first platform and the second platform.

The scaffolding may include a lower support beam supporting the first platform and a middle support beam supporting the second platform.

The system may further include an exterior beam connecting the lower support beam to the middle support beam.

The bridge tower apparatus may further include a wheel and a spring urging the wheel from the scaffolding to a bridge tower shaft.

DETAILED DESCRIPTION

Figure 1:
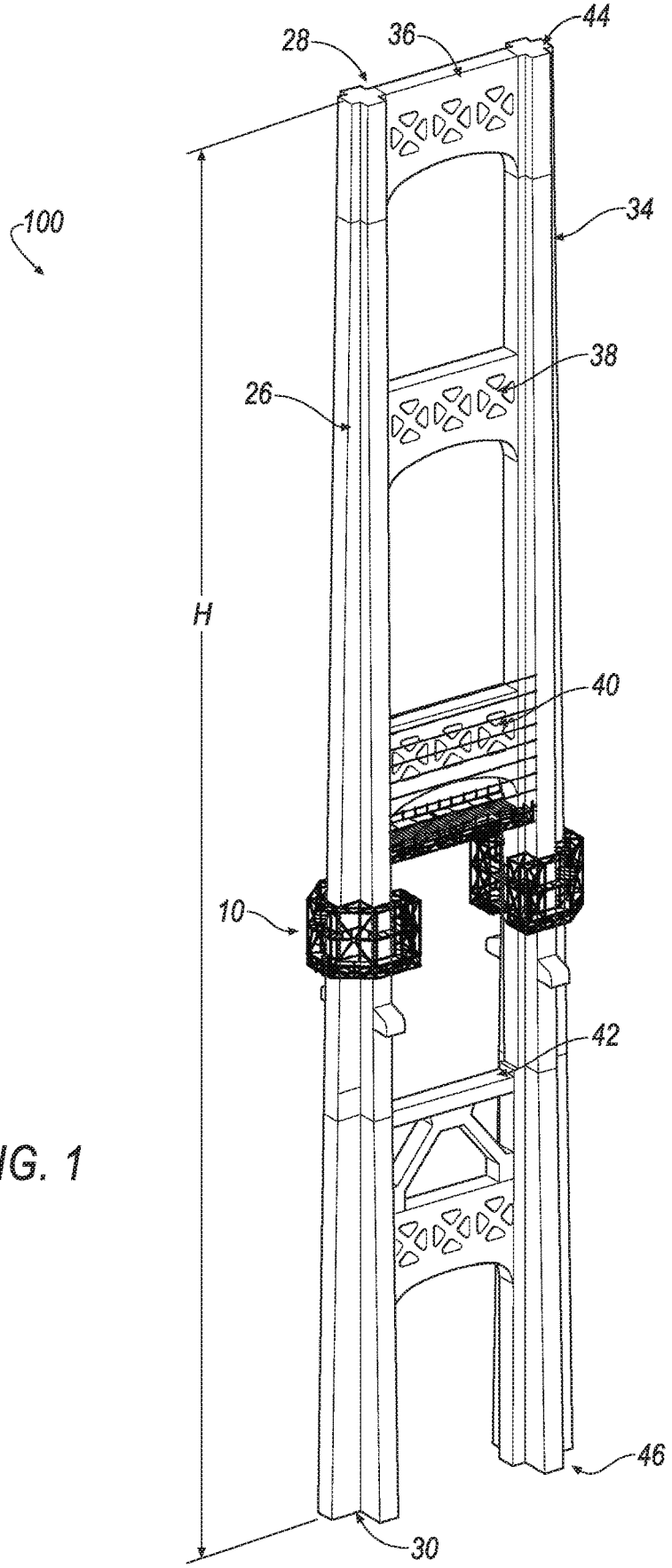
FIG. 1 is a view of a bridge tower.

With reference to the Figures, wherein like numerals indicate like parts throughout the several views, an apparatus 10 for a bridge tower 100 includes a first platform 12, a second platform 14 disposed above the first platform 12, a scaffolding 16 connecting the first and second platforms 12, 14 including an upper support beam 18, a middle support beam 20, and a lower support beam 22, and a cable 24 attached to the upper support beam 18. The lower support beam 22 supports the first platform 12, the middle support beam 20 supports the second platform 14, and the upper support beam 18 is disposed above the second platform 14.

The apparatus 10 may be designed to support the first platform 12 and the second platform 14 along a height H of a bridge tower shaft 26 of the bridge tower 100. The bridge tower shaft 26 may have a height H of, e.g., 500 feet. Thus, the apparatus 10 should be light enough to allow assembly with virtually no mechanized equipment. By using the support beams 18, 20, 22 and the platforms 12, 14, the apparatus 10 may be light enough to move along the height H of the bridge tower shaft 26 and sturdy enough to support the weight of workers and equipment working on the tower shaft 26. Thus, rather than building scaffolding that extends along the entire height H of the bridge tower shaft 26 beneath the water, the bridge tower apparatus 10 can quickly and efficiently be constructed and deployed to move workers along the bridge tower shaft 26, reducing the amount of time to perform maintenance and the amount of time that the roadway lanes on the bridge are closed.

By providing the first platform 12 and the second platform 14, the apparatus 10 may support a plurality of workers and equipment to perform work on the bridge tower shaft 26. The apparatus 10 may move along the tower shaft 26, allowing the workers to perform work quickly and efficiently. With the first platform 12 and the second platform 14, the apparatus 10 may allow workers to more efficiently perform maintenance on the tower shaft 26, e.g., to paint the tower shaft 26. Furthermore, the first platform 12 and the second platform 14 provide structure to the apparatus 10 that may overcome large wind loads.

The apparatus 10 may withstand large wind loads. As bridges typically extend over water, wind speeds may be greater on bridges than on dry land. As a result, structures used on bridges, e.g., bridge tower apparatuses 10, should be able to withstand loads from winds. The use of the upper support beam 18, the middle support beam 20, and the lower support beam 22 allow wind to pass through the apparatus 10. Furthermore, the first platform 12 and the second platform 14 provide support to the support beams 18, 20, 22, preventing axial rotation of the support beams 18, 20, 22 relative to each other. For example, the apparatus 10 may be designed for use in winds having a 1 minute running average speed of 80 miles per hour (mph) (preferably 60 mph), and 3-second gusts of 98 mph (preferably 73 mph). Thus, the workers may continue to perform maintenance on the tower shaft 26 even in windy conditions because the apparatus 10 reduces jostling in the wind.

The tower shaft 26 may taper from a top 28 of the tower shaft 26 to a bottom 30 of the tower shaft 26, e.g., the top 28 of the tower shaft 26 may be narrower than the bottom 30 of the tower shaft 26. The tapering of the tower shaft 26 allows the bottom 30 of the tower shaft 26 to support the weight of other portions of the tower shaft 26, increasing stability of the tower shaft 26. Thus, the apparatus 10 must be adjustable to the differing diameter of the tower shaft. A wheel 32 may be attached to the scaffolding 16 with a spring-loaded connector 56 (e.g., a telescoping rod) that contracts as the apparatus 10 descends the tower shaft 26. The spring-loaded connector 56 may keep the wheel 32 in contact with the tower shaft 26 while allowing the apparatus 10 to move along the tower shaft 26, i.e., the spring-loaded connector 56 may urge the wheel 32 from the scaffolding 16 to the tower shaft 26. The spring-loaded connector 56 may reduce swinging of the first platform 12 and the second platform 14 in wind. Furthermore, the apparatus 10 may include planks (not shown) to extend the first platform 12 and the second platform 14 to reach the tower shaft 26, e.g., in upper sections of the tower shaft 26 that are narrower than the lower sections. The planks allow the workers to reach the tower shaft 26 from the platform 12 and the second platform 14.

FIG. 1 shows an example bridge tower 100. The bridge tower 100 supports a bridge deck (not shown) disposed above the ground. The bridge tower 100 may include a first tower shaft 26 and a second tower shaft 34. The first tower shaft 26 and the second tower shaft 34 are structures connected to the ground, supporting the weight of the bridge deck and objects travelling along the bridge deck. The first tower shaft 26 and the second tower shaft 34 may require service, e.g., repairs, painting, etc. The first tower shaft 26 includes a top 28 and a bottom 30. The second tower shaft 34 includes a top 44 and a bottom 46. The tower shafts 26, 34 may be any suitable material, e.g., concrete, metal, etc.

The first tower shaft 26 and the second tower shaft 34 may taper from the respective top 28, 44 to the respective bottom 30, 46. For example, as shown in FIG. 1, the top 28, 44 may be narrower than the bottom 30, 46. By tapering the first tower shaft 26 and the second tower shaft 34, stresses induced by the bridge tower 100 may be supported by the wider bottom 30, 46.

The bridge tower 100 may include at least one tower strut 36, 38, 40, 42 connecting the first tower shaft 26 and the second tower shaft 34. In the example of FIG. 1, the bridge tower 100 includes a first tower strut 36, a second tower strut 38, a third tower strut 40, and a fourth tower strut 42. The bridge tower 100 may include a different number of tower struts 36, 38, 40, 42 connecting the first tower shaft 26 and the second tower shaft 34. The tower struts 36, 38, 40, 42 connect and support the first tower shaft 26 and the second tower shaft 34. The tower struts 36, 38, 40, 42 may transmit and absorb forces between the first tower shaft 26 and the second tower shaft 34. The tower struts 36, 38, 40, 42 may be designed to connect the first tower shaft 26 and the second tower shaft 34 as the tower shafts 26, 34 taper.

Figure 2:
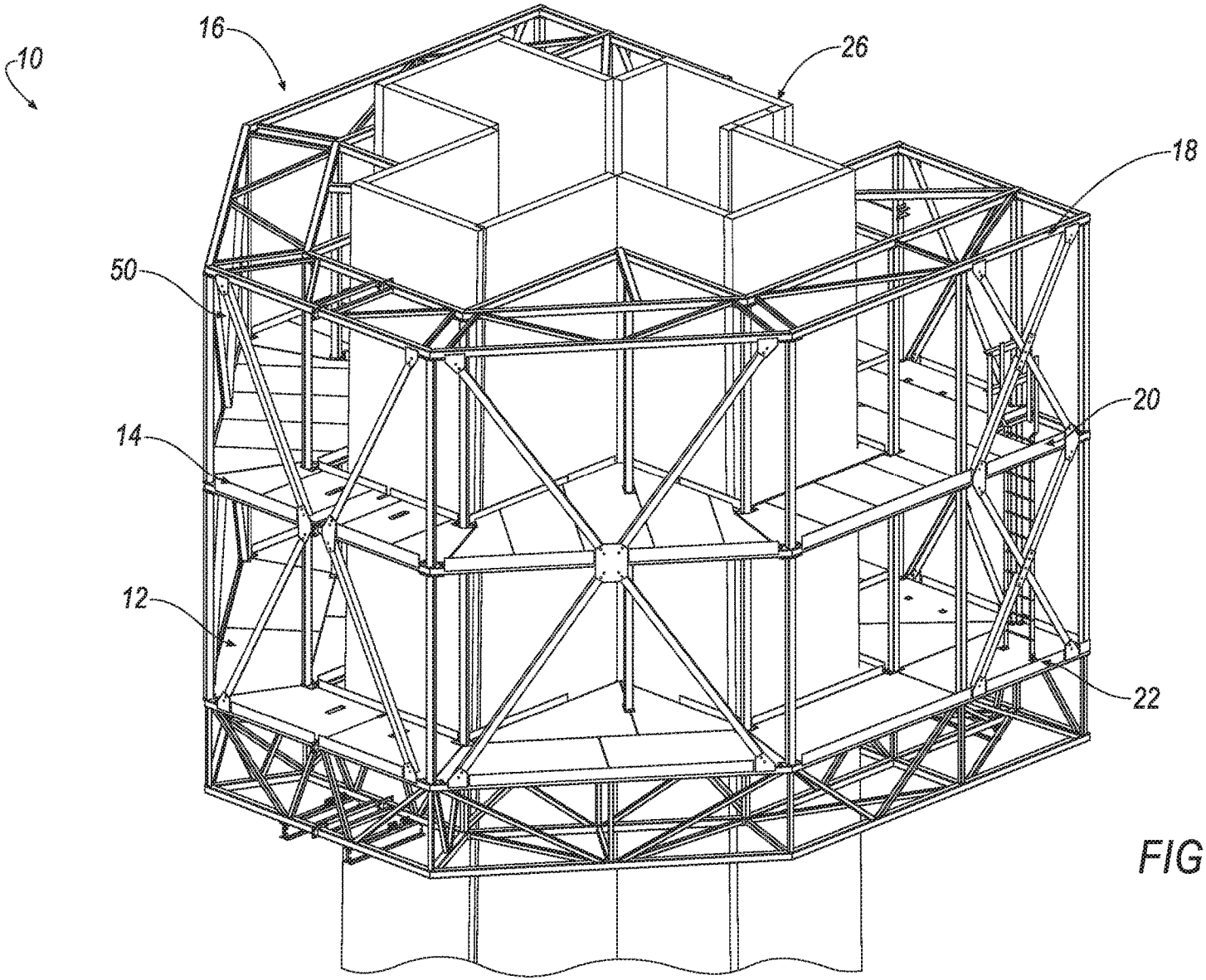
FIG. 2 is a perspective view of a bridge tower apparatus.

FIG. 2 illustrates a bridge tower apparatus 10. The bridge tower apparatus 10 supports workers performing service on the bridge tower 100. For example, the bridge tower apparatus 10 may support painters painting the tower shafts 26, 34. The bridge tower apparatus 10 may move along the first tower shaft 26 from the top 28 to the bottom 46. The bridge tower apparatus 10 may extend around the first tower shaft 26. The bridge tower apparatus 10 may be designed to withstand jostling from wind loads, allowing the workers to perform service more efficiently and reducing downtime of the roadways. The bridge tower apparatus 10 may be designed for quick assembly and deployment for supporting workers performing service on the tower shaft 26. The bridge tower apparatus 10 requires less material than traditional stationary scaffolding and can be moved along the tower shaft 26, which allows the workers and the equipment to move along the tower shaft 26 rather than manually moving the equipment for stationary scaffolding.

The bridge tower apparatus 10 includes scaffolding 16. The scaffolding 16 supports workers performing service on the bridge tower 100. That is, the scaffolding 16 may be raised and lowered relative to the first tower shaft 26 to allow the workers to service the bridge tower 100. The scaffolding 16 may include a plurality of beams. The beams may include an upper support beam 18, a middle support beam 20, and a lower support beam 22. The beams 18, 20, 22 may be elongated members, e.g., tubes, rods, etc. The beams 18, 20, 22 may be any suitable material, e.g., steel, aluminum, etc. The support beams 18, 20, 22 support platforms 12, 14. The scaffolding 16 may extend around the first tower shaft 26. The scaffolding 16 may be designed to enclose the widest portion of the first tower shaft 26. For example, the scaffolding 16 may have a length of about 30 feet and a width of about 32 feet to enclose the first tower shaft 26 and to support workers performing service on the first tower shaft 36. The scaffolding 16 may have a height of about 20 feet. Thus, rather than building scaffolding extending several hundred feet above and below the water, the bridge tower apparatus 10 can include the scaffolding 16 that requires much less material and can be built much more quickly to expedite maintenance on the bridge tower 100.

The scaffolding 16 may include at least one exterior beam 50. The exterior beam 50 may connect the upper support beam 18 to the lower support beam 22. The exterior beam 50 may further connect to the middle support beam 20. The exterior beam 50 may support the upper support beam 18, the middle support beam 20, and the lower support beam 22. The scaffolding 16 may include a plurality of exterior beams 50 to support the upper support beam 18, the middle support beam 20, and the lower support beam 22. The exterior beam 50 may be any suitable material, e.g., steel, aluminum, etc. One or more of the exterior beams 50 may be a different material than one or more other exterior beams 50 to provide specific weight, strength, and flexibility characteristics for the scaffolding 16. For example, exterior beams 50 vertically connecting the upper support beam 18 to the middle support beam 20 may be steel to provide additional strength (as they bear more of the loads from the second platform 14), and exterior beams 50 diagonally connecting the upper support beam 18 to the middle support beam 20 may be aluminum to reduce overall weight of the scaffolding 16.

The exterior beams 50 may be arranged to absorb loads from the beams 18, 20, 22. For example, the exterior beams 50 may be arranged as trusses. That is, the exterior beams 50 may be arranged to form triangles with the beams 18, 20, 22, advantageously absorbing loads from workers and equipment. The specific geometric arrangement can be determined to absorb modeled forces on the scaffolding 16 from, e.g., wind. As shown in FIG. 2, the exterior beams 50 are arranged around the bridge tower shaft 26 to allow access to all sides of the bridge tower shaft 26 by the workers. Alternatively, the exterior beams 50 may be arranged in any suitable arrangement. The support beams 18, 20, 22 and the exterior beams 50 may be arranged to extend around the first tower shaft 26.

The bridge tower apparatus 10 includes a platform 12. The lower support beam 22 supports the platform 12. The platform 12 may be attached to the lower support beam 22 in any suitable manner, e.g., screws, bolts, dowels, welds, etc. The platform 12 may support workers and equipment, e.g., painters and paint equipment to paint the bridge tower 100. That is, the weight of the workers and the equipment transfers to the platform 12 and then to the lower support beam 22. The lower support beam 22 transfers the weight to the exterior beams 50. Thus, the scaffolding 16 as a whole supports the platform 12. The lower support beam 22 may reduce jostling of the platform 12 in wind, allowing the workers to continue performing maintenance on the tower shaft 26 at wind speeds up to 60 mph.

The platform 12 may extend around the first tower shaft 26, allowing workers access around the first tower shaft 26. The platform 12 may be a substantially flat sheet of metal (e.g., steel, aluminum, etc.). The platform 12 has a suitable thickness to support the weight of the workers and the equipment without bending or cracking. The platform 12 may include an extending plank (not shown). The extending plank allows the platform 12 to extend to the tower shaft 26 when the tower shaft 26 tapers to a narrower portion of the tower shaft 26. That is, the platform 12 may be designed to reach the widest portion of the tower shaft 26, and the extending plank may extend the platform 12 to reach the narrower portions of the tower shaft 26, allowing workers to paint the tower shaft 26. The extending plank may be, e.g., steel, aluminum, etc.

The bridge tower apparatus 10 includes a second platform 14. The second platform 14 is disposed above the platform 12. The middle support beam 20 supports the second platform 14, transferring loads from the second platform 14 to the exterior beams 50. The upper support beam 18 is disposed above the second platform 14. The second platform 14 may support additional worked and equipment, e.g., painters and paint equipment to paint the bridge tower 100. Thus, the workers on the platform 12 and the second platform 14 may perform service on the tower shaft 26 more quickly, reducing the closure time of the roadway lanes. The scaffolding 16, including the beams 18, 20, 22, the platform 12, and the second platform 14 may be designed to support the weight of a plurality of workers and equipment. The second platform 14 may include a second extending plank (not shown) to extend the second platform 14 to the tower shaft 26. The first platform 12 may be disposed below the second platform 14, i.e., the first platform 12 may be a lower platform and the second platform 14 may be an upper platform.

Figure 4:
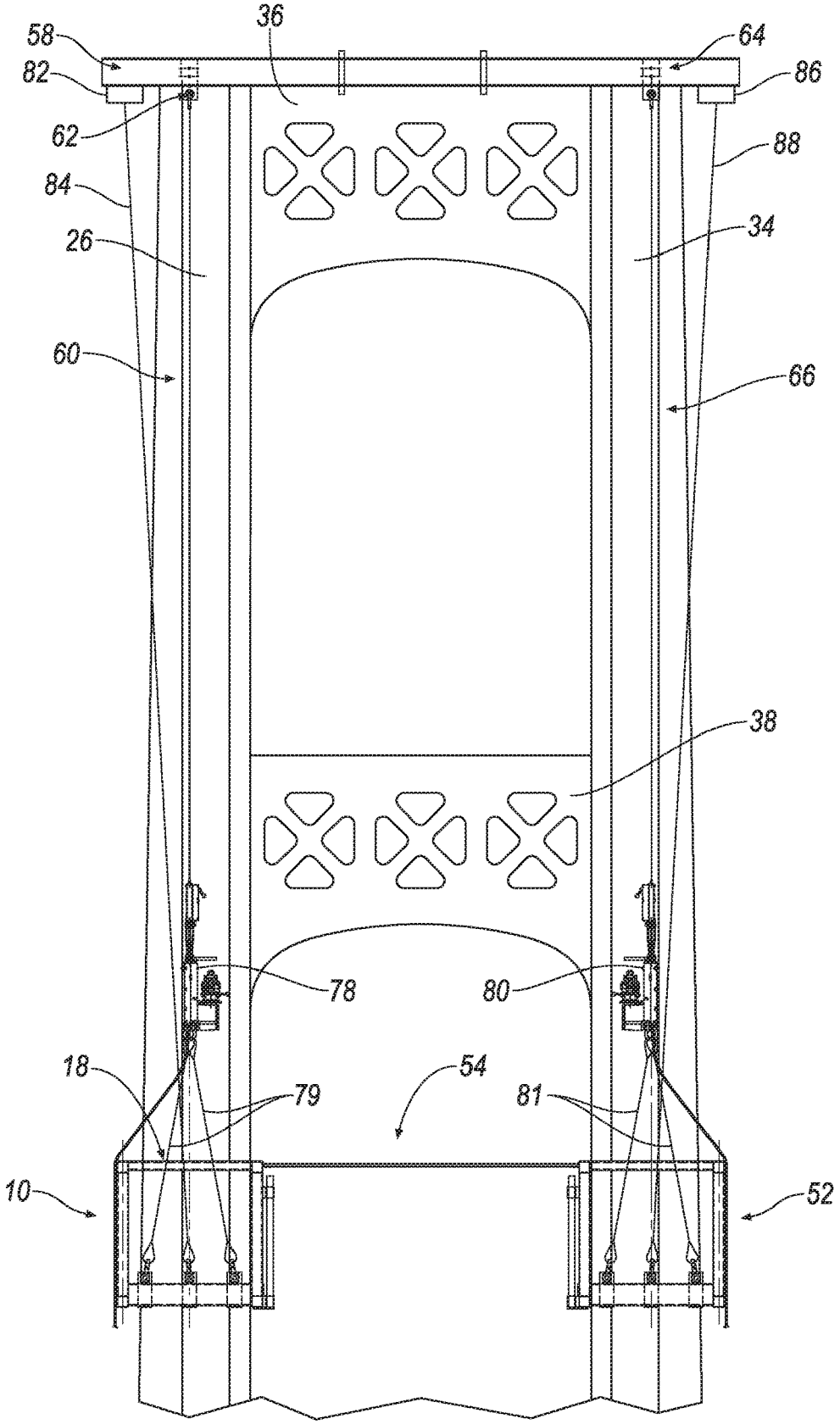
FIG. 4 is a side view of the bridge tower apparatus and a second bridge tower apparatus.
Figure 5:
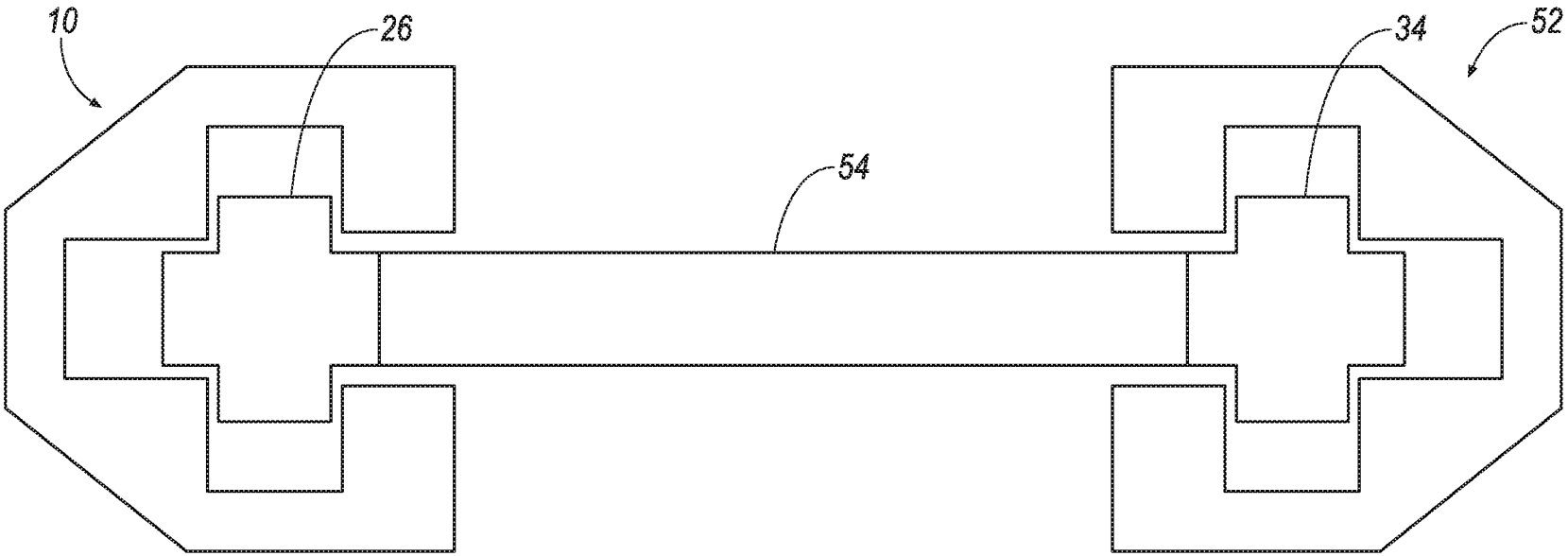
FIG. 5 is a plan view of the bridge tower apparatus and the second bridge tower apparatus.

The bridge tower 100 may include a second bridge tower apparatus 52, as shown in FIGS. 4 and 5. The second bridge tower apparatus 52 may be constructed in a similar manner to the bridge tower apparatus 10 and may extend around the second tower shaft 34. That is, the second bridge tower apparatus 52 may include a scaffolding with a plurality of beams that are shaped in a suitable manner around the second tower shaft 34. The second bridge tower apparatus 52 may have a plurality of platforms supported by the scaffolding to support the weight of workers and equipment. The second bridge tower apparatus 52 may support workers working on the second tower shaft 34. Thus, the bridge tower 100 may support two sets of workers on the bridge tower apparatuses 10, 52 to simultaneously service the tower shafts 26, 34. Using two bridge tower apparatuses 10, 52 can improve efficiency of the service performed on the tower shafts 26, 34, reducing the amount of closure time for the roadway lanes on the bridge.

The bridge tower 100 may include a connector 54, as shown in FIGS. 4 and 5. The connector 54 may extend between the bridge tower apparatus 10 and the second bridge tower apparatus 52. The connector 54 may be used when the bridge tower apparatus 10 and the second bridge tower apparatus 52 are stationary and at the same elevation. The connector 54 allows workers and equipment to move between the bridge tower apparatus 10 and the second bridge tower apparatus 52. The connector 54 may be extendable from an undeployed position to a deployed position. In the undeployed position, the connector 54 may be stowed on one of the bridge tower apparatus 10 or the second bridge tower apparatus 52 during movement along the first tower shaft 26 or the second tower shaft 34. In the deployed position, the connector 54 may extend the length between the first tower shaft 26 and the second tower shaft 34. The connector 54 may be, e.g., a flat sheet of material (e.g. a metal, a polymer, a composite, etc.) that may support one or more workers and equipment moving between the bridge tower apparatus 10 and the second bridge tower apparatus 52. Alternatively, the connector 54 may be a plurality of sheets connected together to extend between the bridge tower apparatus 10 and the second bridge tower apparatus 52. The connector 54 may be extended between the bridge tower apparatus 10 and the second bridge tower apparatus 52 along one of the tower struts 36, 38, 40, 42, allowing the workers to service the tower struts 36, 38, 40, 42.

The connector 54 may be extendable to the distance between the first tower shaft 26 and the second tower shaft 34 as the tower shafts 26, 34 taper, i.e., the connector 54 may be extendable from a first length that is the length between the tower shafts 26, 34 at their respective widest points in a plane parallel to the ground to a second length that is the length between the tower shafts 26, 34 at their respective narrowest points in a plane parallel to the ground. That is, the connector 54 may include extendable sections (not shown) that can be deployed or retracted to extend the connector 54 from the first tower shaft 26 to the second tower shaft 34.

Figure 6:
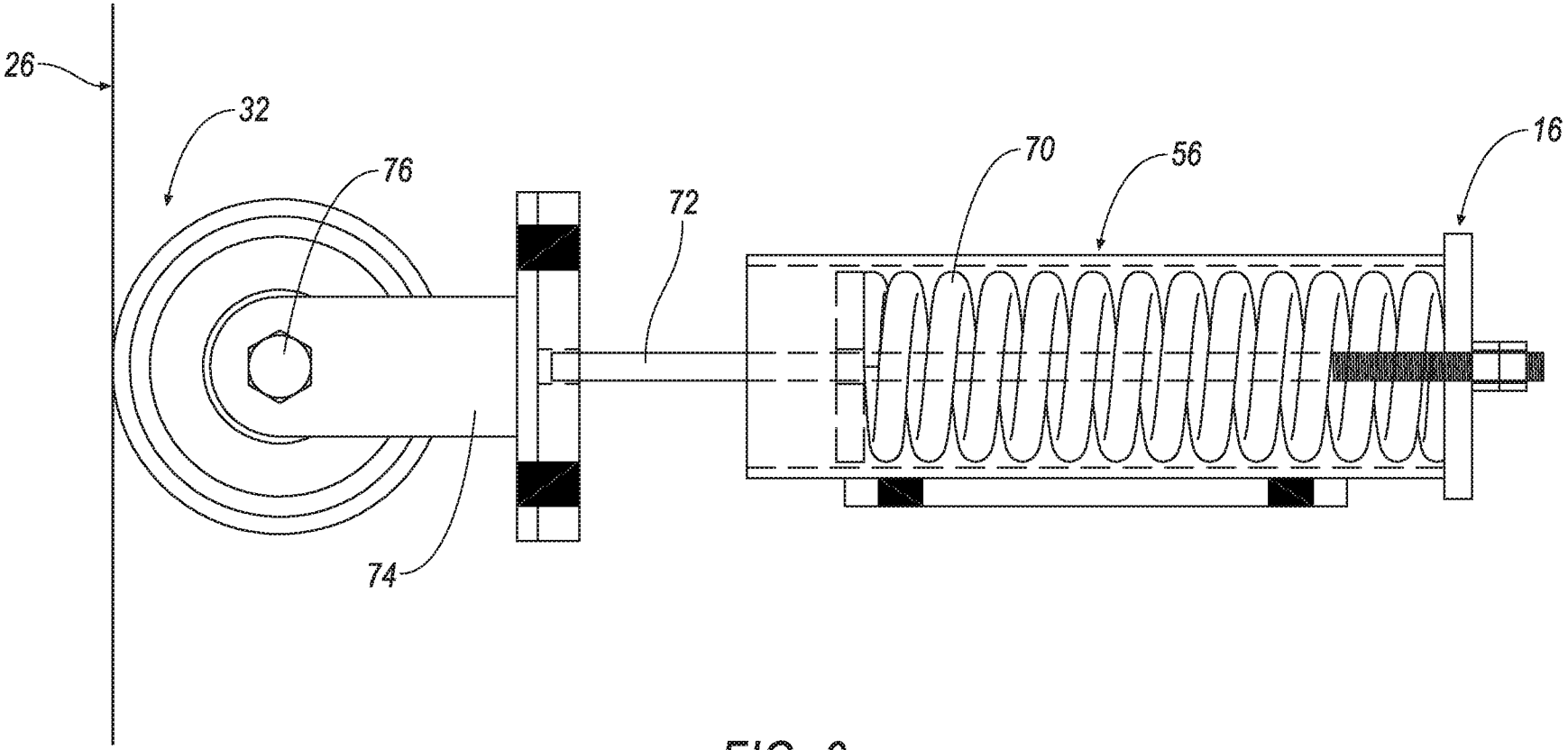
FIG. 6 is a side view of a wheel.

As shown in FIG. 6, the bridge tower apparatus 10 may include a wheel 32. The wheel 32 may be rotatably connected to the scaffolding 16. The wheel 32 may contact the first tower shaft 26. As the scaffolding 16 moves along the first tower shaft 26, the wheel 32 may rotate, allowing the scaffolding 16 to remain close to the first tower shaft 26 without contacting the first tower shaft 26. The wheel 32 may be connected to the scaffolding 16 with a spring-loaded connector 56. The wheel 32 may include a metal hub and a rubber tire. The rubber tire contacts and rolls against the first tower shaft 26.

The spring-loaded connector 56 may include a spring 70, a rod 72, and a housing 74. The spring 70 may have a tension strength, i.e., a spring constant, suitable for urging the wheel 32 against the first tower shaft 26. The rod 72 may be fixed to the housing 74. The rod 72 may be a telescoping rod 72, i.e., having a plurality of concentric sections that may be disposed within one another. The housing 74 may support the wheel 32. The housing 74 may be rotatably attached to the wheel 32 with a rotating connector 76, e.g., a bearing, a shaft, etc. The rotating connector 76 allows the wheel 32 to rotate relative to the housing 74. As the bridge tower apparatus 10 moves down the first tower shaft 26, the first tower shaft 26 compresses the spring 70, moving the rod 72 toward while the rotating connector 76 allows the wheel 32 to roll along the first tower shaft 26. The tension in the spring 70 ensures contact between the wheel 32 and the first tower shaft 26. The spring-loaded connector 56 may extend from a compressed length of about 1 foot to an extended length of about 2 feet. The bridge tower apparatus 10 may include a plurality of wheels 32 disposed on one or more of the exterior beams 50 to allow the bridge tower apparatus 10 to slide along the first tower shaft 26.

The spring-loaded connector 56 urges the wheel 32 against the first tower shaft 26. As the bridge tower apparatus 10 moves vertically along the first tower shaft 26, which tapers between the top 28 and the bottom 30, the scaffolding 16 and the wheel 32 may contract the spring 70 as the first tower shaft 26 widens toward the bottom 30. The tension in the spring 70 urges the wheel 32 to remain in contact as the first tower shaft 26 widens as the bridge tower apparatus 10 moves vertically down the first tower shaft 26, allowing the scaffolding 16 to maintain its horizontal position relative to a center of the first tower shaft 26. As the bridge tower apparatus 10 moves up along the first tower shaft 26, the spring 70 urges the wheel 32 to maintain contact, rolling along the surface of the first tower shaft 26 as the first tower shaft 26 narrows.

The bridge tower 100 may include a crane 58, as shown in FIG. 4. The crane 58 may be fixed to the top of one of the first tower shaft 26 and the second tower shaft 34. The crane 58 is arranged to move the bridge tower apparatus 10 along the first bridge tower shaft 26, allowing workers to perform maintenance along the bridge tower shaft 26 without additional scaffolding. The crane 58 may include a cable 60. The cable 60 may be attached to the upper support beam 18 and/or the middle support beam 20 and/or the lower support beam 22. The cable 60 may be a suitable width, e.g., 9⁄16", to support the bridge tower apparatus 10. The cable 60 transfers the weight of the bridge tower apparatus 10 to the first tower shaft 26

The crane 58 may include a motor 62. The cable 60 may be fixed to the motor 62. That is, the cable 60 may be coiled around the motor 62. As the motor 62 rotates, the cable 60 coils to or uncoils from the motor 62, raising and lowering the bridge tower apparatus 10 along the first tower shaft 26. The crane 58 thus moves the bridge tower apparatus 10 along the first tower shaft 26. The motor 62 may have a suitable horsepower rating to move the weight of the bridge tower apparatus 10 and the workers and equipment thereupon. The bridge tower 100 may include a second crane 64 including a second cable 66 attached to the second bridge tower apparatus 52 to move the second bridge tower apparatus 52 along the second tower shaft 34.

The bridge tower 100 may include a hoist 78. The hoist 78 is supported by the cable 60. The hoist supports the bridge tower apparatus 10. The hoist 78 may be a pneumatic hoist. Alternatively, the hoist 78 may be an electric hoist. The hoist 78 may have a capacity to support the bridge tower apparatus 10. For example, the hoist 78 may have a capacity of 5850 lb to support a portion of the weight of the bridge tower apparatus 10 and the workers. The hoist 78 includes hoist lines 79 connecting the hoist 78 to the scaffolding 16. The bridge tower 100 may include a second hoist 80 supporting the second bridge tower apparatus 52. The second hoist 80 includes hoist lines 81 connecting the second hoist 80 to the scaffolding of the second bridge tower apparatus 52.

The crane 58 is connected to the hoist 78 via the cable 60. The second crane 64 is connected to the second hoist 80 via the second cable 66. The cranes 58, 64 deploy and retract their respective cables 60, 66, raising and lowering the hoists 78, 80, and thus the bridge tower apparatuses 10, 52. The motor 62 may be rated to support the weight supported by the hoist 78, i.e., a portion of the weight of the bridge tower apparatus 10 and workers on the bridge tower apparatus 10.

The bridge tower apparatus 10 may have a weight capacity of 5000 lbs, e.g., enough for 4 workers and equipment to perform maintenance on the tower shaft 26 with a safety factor of at least 4. The bridge tower apparatus 10 may be supported by a plurality of cables 60 each connected to one of a plurality of hoists 78. The bridge tower 100 may include a suitable number of hoists 78 to support the bridge tower apparatuses 10. That is, based on the necessary number of workers, and thus the size of the bridge tower apparatus 10, a plurality of hoists 78 can be used.

The bridge tower 100 may include an anchor 82 and an anchor cable 84. The anchor cable 84 connects the bridge tower apparatus 10 to the anchor 82. The anchor 82 supports at least a portion of the weight of the bridge tower apparatus 10. The anchor cable 84 may be wound about the anchor 82. That is, when the hoist 78 deploys the cable 60 to move the bridge tower apparatus 10, the anchor cable 84 may unwind from the anchor 82, allowing the bridge tower apparatus 10 to move along the bridge tower 100. When the bridge tower apparatus 10 is in a desired location along the bridge tower 100, the hoist 78 halts the cable 60, and the anchor cable 84 locks against the anchor 82. The bridge tower 100 may include a second anchor 86 and a second anchor cable 88 to support at least a portion of the weight of the second bridge tower apparatus 52, The anchor cables 84, 88 may be, e.g., 9/16" in diameter. The bridge tower 100 may include a plurality of anchors 82, 86 and anchor cables 84, 88 to support the weight of the bridge tower apparatuses 10, 52.

Figure 3:
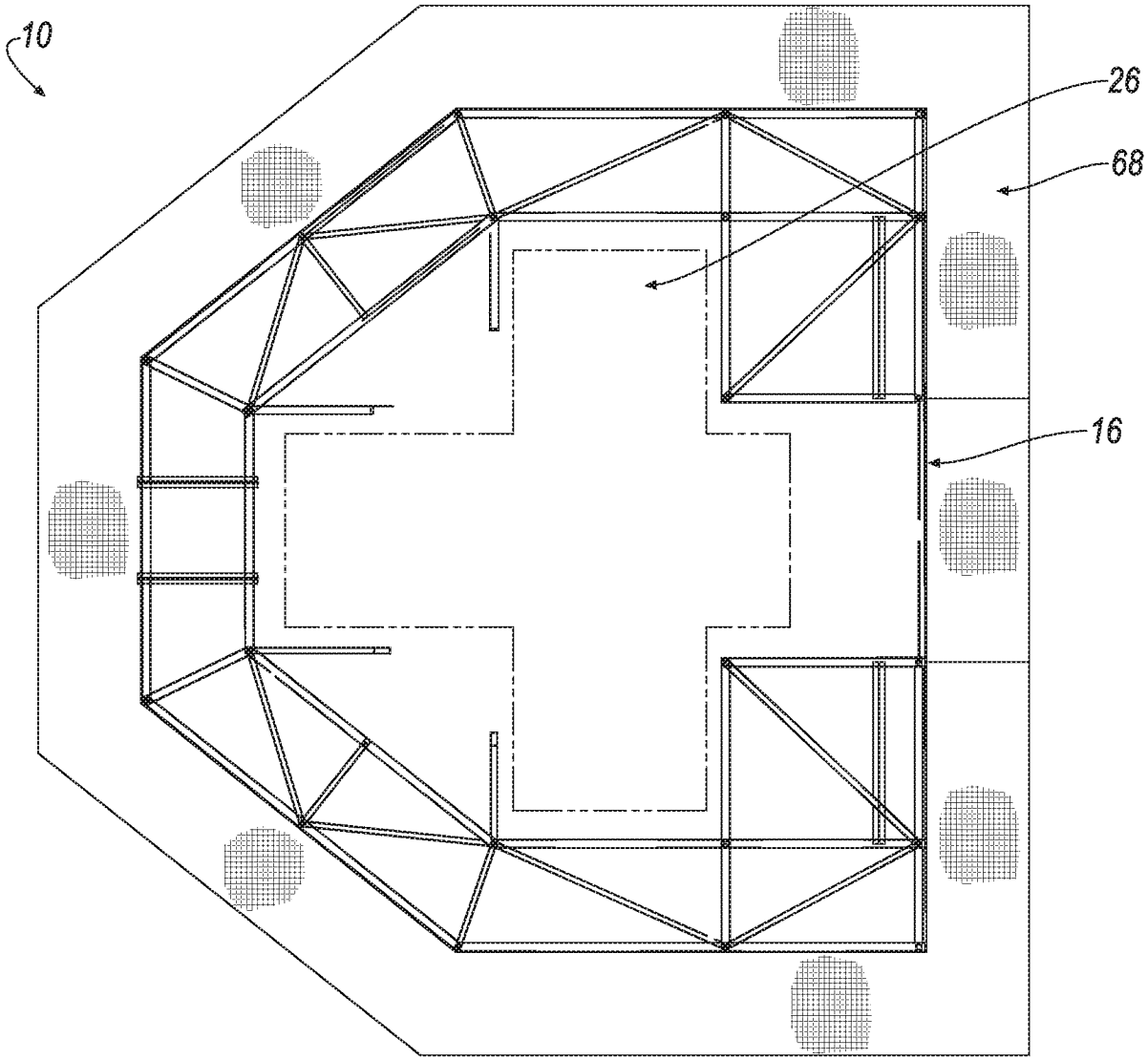
FIG. 3 is a plan view of the bridge tower apparatus.

The bridge tower apparatus 10 may include a debris shield 68, as shown in FIG. 3. The debris shield 68 may be disposed around the scaffolding 16. The debris shield 68 may be attached to one of the beams 18, 20, 22, e.g., the lower support beam 22. The debris shield 68 may be a fabric sheet extending over and/or around the scaffolding 16. The debris shield 68 may protect workers on the platform 12 and the second platform 14 from debris from other parts of the bridge tower 100. The debris shield 68 may collect debris from the platform 12 and the second platform 14, preventing the debris from falling away from the bridge tower apparatus 10. The bridge tower apparatus 10 may include a plurality of debris shields 68, each debris shield 68 attached to at least one of the beams 18, 20, 22, to collect debris from the platforms 12, 14.

Figure 7:
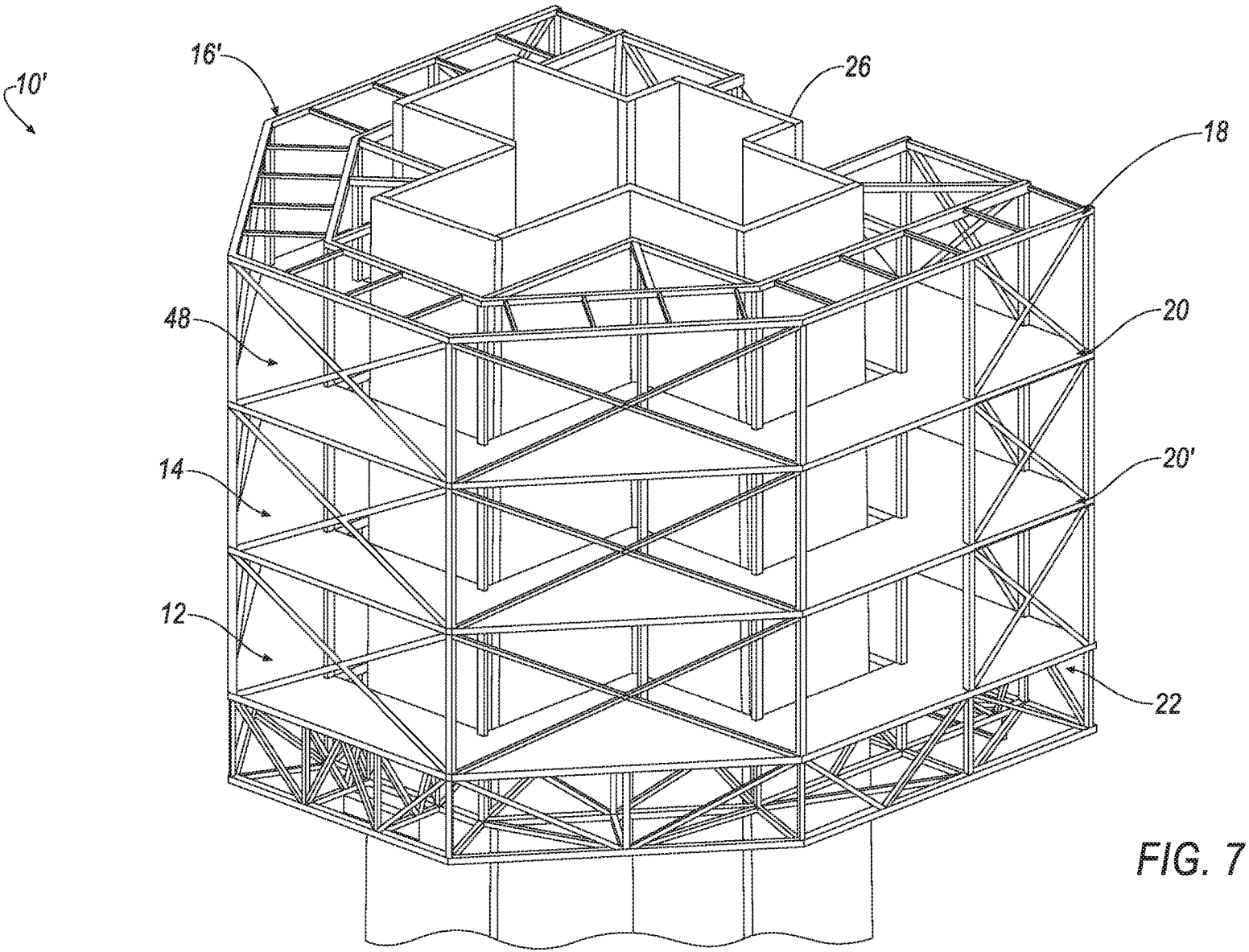
FIG. 7 is a view of a bridge tower apparatus.

FIG. 7 shows a bridge tower apparatus 10' that may include a third platform 48. The third platform 48 may be disposed above the second platform 14. Scaffolding 16' may support the platform 12, the second platform 14, and the third platform 48. The scaffolding 16' may include the upper support beam 18, the middle support beam 20, a second middle support beam 20', and the lower support beam 22. The third platform 48 may support additional workers and equipment, e.g., painters and paint equipment to paint the bridge tower 100. The bridge tower apparatus 10, 10' may include a different number of platforms. By using a plurality of platforms, the bridge tower apparatus 10, 10' may support the required number of workers and amount of equipment to perform maintenance on the tower shaft 26.

The disclosure has been described in an illustrative manner, and it is to be understood that the terminology which has been used is intended to be in the nature of words of description rather than of limitation. The adjectives "first" and "second" are used throughout this document as identifiers and are not intended to signify importance or order. Many modifications and variations of the present disclosure are possible in light of the above teachings, and the disclosure may be practiced otherwise than as specifically described.

What is claimed is:

1. An apparatus, comprising:

a first platform;

a second platform disposed above the first platform;

a scaffolding connecting the first and second platforms including an upper support beam, a middle support beam, and a lower support beam;

a cable attached to the upper support beam;

a wheel attached to the scaffolding and arranged to engage a bridge tower shaft the wheel being rotatable about a first axis;

a coil spring urging the wheel from the scaffolding to the bridge tower shaft along a second axis transverse to the first axis; and a rod connecting the coil spring to the wheel, the rod being disposed within the coil spring;

wherein the lower support beam supports the first platform, the middle support beam supports the second platform, and the upper support beam is disposed above the second platform.

2. The apparatus of claim 1, further comprising a second scaffolding and a connector connecting the scaffolding to the second scaffolding.

3. The apparatus of claim 1, wherein the cable is arranged to vertically move the scaffolding.

4. The apparatus of claim 1, wherein the rod is telescopic.

5. The apparatus of claim 4, further comprising a housing, wherein the housing supports the wheel and the rod is fixed to the housing.

6. The apparatus of claim 1, further comprising a debris shield disposed around the scaffolding.

7. The apparatus of claim 1, further comprising an exterior beam connecting the lower support beam to the middle support beam.

8. The apparatus of claim 7, further comprising a plurality of exterior beams connecting the lower support beam to the middle support beam.

* * * * *